United States Patent [19]

King

[11] 4,406,768

[45] Sep. 27, 1983

[54] ELECTROCHEMICAL CELL ASSEMBLY

[75] Inventor: Christopher J. H. King, Pensacola, Fla.

[73] Assignee: Monsanto Company, St. Louis, Mo.

[21] Appl. No.: 334,335

[22] Filed: Dec. 24, 1981

[51] Int. Cl.[3] ..... C25B 9/00; C25B 15/08

[52] U.S. Cl. ..... 204/268; 204/269; 204/275

[58] Field of Search ..... 204/268–270, 204/254–256, 275–278

[56] References Cited

U.S. PATENT DOCUMENTS

| | | | |
|---|---|---|---|
| 1,541,947 | 6/1925 | Hartman et al. | 204/269 X |
| 1,674,364 | 6/1928 | Hartman | 204/269 |
| 3,669,869 | 6/1972 | Burton | 204/268 |
| 4,048,047 | 9/1977 | Beck et al. | 204/270 |
| 4,124,480 | 11/1978 | Stevenson | 204/268 |
| 4,193,858 | 3/1980 | Loeffler, Jr. | 204/270 X |
| 4,203,821 | 5/1980 | Cramer et al. | 204/268 |
| 4,323,444 | 4/1982 | Kawamura et al. | 204/269 |

*Primary Examiner*—Donald R. Valentine

*Attorney, Agent, or Firm*—Thomas Y. Awalt, Jr.

[57] ABSTRACT

An electrochemical cell assembly comprises stacked bipolar substantially square parallel planar electrodes. The corners and edges of the electrodes with bordering insulative spacers in juxtaposition with the chamber walls define four electrolyte circulation manifolds. Electrolyte channelling means permit the introduction of electrolyte into one or two of the manifolds and the withdrawal of electrolyte from at least one other manifold. The electrodes are separated from one another by the insulative spacers which are also channelling means disposed to provide electrolyte channels across the interfaces of adjacent electrodes.

4 Claims, 1 Drawing Figure

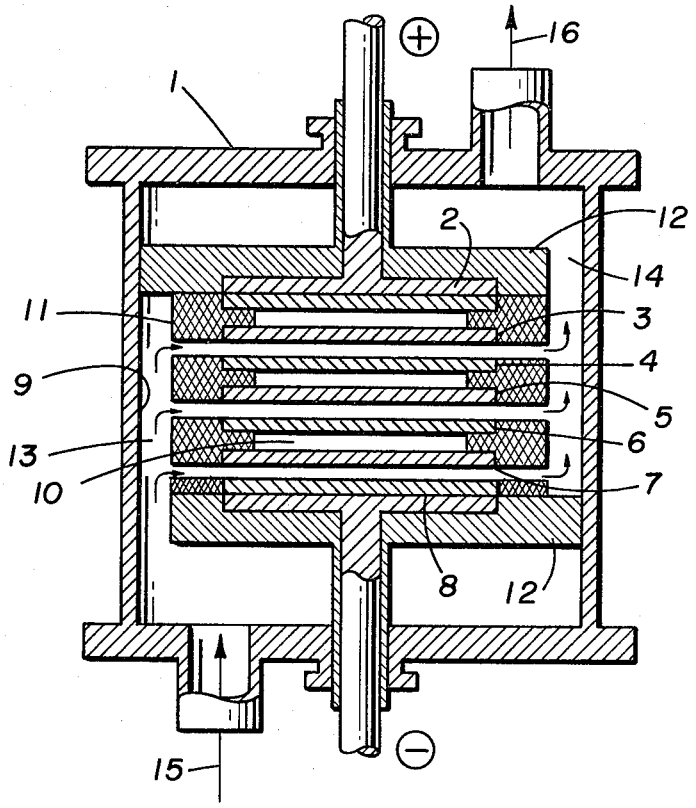
1
2
3
4
5
6
7
8
9
10
11
12
12
13
14
15
16

ELECTROCHEMICAL CELL ASSEMBLY

BACKGROUND OF THE INVENTION

A. Field of the Invention

The invention relates to electrolytic cells for electrochemical synthesis.

B. Description of the Prior Art

Electrochemical devices employing stacked plates are well-known in the art. Conventional stacked plate cells include arrangements wherein planar electrodes of circular shape are located in an electrolyte chamber, spaced apart with radial insulating strips in the form of a stack, in which, with the exception of the outermost electrodes, each electrode acts both as anode and cathode. The electrolyte liquid is fed into the center of the stack, so that, it is operably exposed to the electrodes as it passes outwardly to the periphery of the electrodes. The spacing of the electrodes is fixed by radial strips of insulating non-swelling materials of the desired thickness.

The spacing of the bipolar electrode plates can vary within wide limits, but should be from 0.5 mm to 2 mm. This is because for many electrochemical reactions it is desirable to select a very small spacing so as to keep down the cell voltage and hence the power consumption, and to achieve a high space-time yield, and a low volume flow rate of the circulating electrolyte at a given flow rate.

The prior art teaches that the plates themselves can be circular or be of approximately circular geometrical shape; and that a circular shape permits industrial manufacture of plates of high quality without great expense and makes it possible to set the electrode spacing to less than 1 mm.

With this type of cell construction, the liquid which externally surrounds the plate stack in operation is an electrical shunt, but this is a relatively unimportant factor in electrochemical synthesis if the plate thickness is large compared to the thickness of the capillary gap and can be made even less important if the electrode plates are each surrounded by tightly fitting rings of insulating material. Such a cell construction is taught in U.S. Pat. No. 4,048,047, in which a center feed was employed.

One of the major disadvantages of the stacked cell assembly with center feed, is that the electrode exposure to the electrolyte is not uniform in the sense that there is a greater electrolyte velocity along the inner portions of the electrodes than along the peripheral portions. This inevitably results in a dissimilar exposure pattern between the inner surfaces and the outer surfaces of the electrode. Wherever velocity affects product selectivity, of course, such variations in velocity may substantially affect overall selectivity or yield. In the cell with center feed, moreover, current leakage from within the center feed portion by way of an electrical shunt may be significant.

Since the stacked electrochemical cell is of increasing interest commercially, an electrode arrangement which eliminates the above described disadvantages would represent a significant contribution and advancement in the art, and is an object of this invention.

More specific objects of this invention are specified below.

SUMMARY OF THE INVENTION

The invention is an electrochemical cell assembly comprising an essentially cylindrical electrolytic chamber. Within the chamber is a plurality of stacked bipolar substantially square parallel-planar electrodes. The electrodes are arranged in the chamber so that the corners and edges of the electrodes with bordering insulative spacers along with the walls of the chamber define four electrolyte circulation manifolds. Between the electrodes are at least two substantially parallel insulative spacers which hold the electrodes apart from one another, provide electrolyte channels across the inner faces of adjacent electrodes, and insulate portions of the electrode from the electrolyte. The channels may be alternating at right angles to one another, or there may be several electrodes in a series separated by parallel spacers in which all channelling is in the same direction followed by another series in which the channelling is at right angles. The outermost electrodes are monopolar, and all of the other electrodes are bipolar. The assembly provides for means for introducing the electrolyte at one end of the chamber, and into at least one and not more than two of the manifolds. It also includes means for exiting the electrolyte at the other end of the chamber.

In the detailed description, reference will be made to the drawing in which

The FIGURE is a schematic showing a vertical section of a preferred embodiment of this invention in which the cell is undivided.

Specific advantages of this invention over devices typically of the prior art include the following:

This type of the design has a high specific electrode area, and in this particular cell design, may reach as high as 46 sq.ft./cubic ft. The fitting of electrode spaces is simple and they are kept in place by pack compression.

Individual cells do not require leak-free sealing, and the end plates of the cell vessel are easy to seal.

Electrodes can be pre-assembled in a frame for ready replacement of used electrodes.

Simple fabrication and the limited number of connecting parts make gasket replacement simple, and the replacement of damaged parts is facilitated.

The cell structure is inherently low in cost and more sensitive to the cost of electrode material.

Electrolyte flooded operation avoids possible detonation of gas spaces. Also, with minimal chance of electrolyte leakage, the fire hazard is minimized when the electrolyte contains flammables.

Specific advantages of this invention over such cells as taught in U.S. Pat. No. 4,048,047 include the following:

Materials are often available (or can be easily cut) as square planar sheets, not requiring fabrication.

In some electrode processes, electrolyte velocity influences product selectivity, and to the extent there are different velocities, there are variations in selectivity. This invention provides essentially uniform form throughout.

The insulative cell spacer material can be extended in width to act as inlet and exit channel for adjacent cells, and thereby offer resistance to current leakage. These insulative electrode skirts are easy to make for and apply to square packs.

DETAILED DESCRIPTION OF THE INVENTION

Referring now in detail to the FIGURE, electrochemical cell assembly 1 comprises single polar electrodes 2 and 8 and bipolar electrodes 3–7 stacked within the inner wall 9 of the assembly. Between electrodes 2 and 3, 4 and 5, 6 and 7 are spaces 10 which are maintained by parallel insulative spacers 11. Spacers 11 and alternate spacers (not shown) at right angles thereto along with terminal insulators 12 channel the electrolyte from front to rear and from left to right as shown by the arrows from entrance manifolds 13, through the channels shown and out through exit manifolds 14. In operation, the electrolyte follows the arrows, with both entry and exit at opposite ends of the assembly. Flow of electrolyte parallel to spacers and between electrodes 2 and 3, 4 and 5, 6 and 7, is from front to rear. The electrolyte is introduced into the assembly at orifice 15 and withdrawn from the assembly at orifice 16.

I claim:

1. An electrochemical cell assembly comprising a cylindrical electrolytic chamber having interior peripheral walls, a plurality of stacked bi-polar substantially square parallel planar electrodes so arranged within the chamber that the corners and edges of the electrodes in juxtaposition with the interior peripheral walls of the chamber define four electrolyte circulation manifolds, means for applying a direct current across the stack of electrodes, means for introducing electrolyte at one end of the chamber, means for introducing electrolyte into at least one and not more than two of the manifolds, means for withdrawing the electrolyte from at least one other manifold, means for exiting the electrolyte at the other end of the cylinder, and channelling and insulative spacer means comprising at least two spacers between and along the edges of each pair of adjacent electrodes so disposed as to provide full-length, monodirectional electrolyte channels across the interfaces of adjacent electrodes.

2. The electrochemical cell assembly of claim 1 wherein alternating electrolyte channels between adjacent electrodes are at right angles to one another.

3. the electrochemical cell assembly of claim 1 wherein a plurality of consecutive adjacent electrolyte channels between consecutive adjacent electrodes are parallel.

4. The electrochemical cell assembly of claim 1 wherein alternating groups of electrodes with parallel electrolyte channels have electrolyte channels at right angles to one another.

* * * * *